US010875159B2

(12) United States Patent
Banko

(10) Patent No.: US 10,875,159 B2
(45) Date of Patent: Dec. 29, 2020

(54) HAND-HELD WRENCH DEVICE

(71) Applicant: David N. Banko, Raleigh, NC (US)

(72) Inventor: David N. Banko, Raleigh, NC (US)

( * ) Notice: Subject to any disclaimer, the term of this patent is extended or adjusted under 35 U.S.C. 154(b) by 123 days.

(21) Appl. No.: 15/262,129

(22) Filed: Sep. 12, 2016

(65) Prior Publication Data

US 2018/0071897 A1 Mar. 15, 2018

(51) Int. Cl.
*B25B 13/50* (2006.01)
*B25B 13/48* (2006.01)
*B25B 23/10* (2006.01)

(52) U.S. Cl.
CPC ..... *B25B 13/5091* (2013.01); *B25B 13/481* (2013.01)

(58) Field of Classification Search
CPC ..... B25B 13/5091; B25B 13/481
See application file for complete search history.

(56) References Cited

U.S. PATENT DOCUMENTS 5,542,322 A * 8/1996 Knox ..... B25B 13/461 81/177.6
6,701,807 B1 3/2004 Gammon
7,182,003 B1 * 2/2007 Hsieh ..... B25B 13/461 411/403
D592,471 S * 5/2009 Rosko ..... D8/28
9,919,410 B2 * 3/2018 Chen ..... H02P 25/032
2006/0243102 A1 11/2006 Vines

OTHER PUBLICATIONS

Plumbers EZ Helper, Plumbing Wrench, Kitchen Strainer Retainer Nut/round(white) PVC Shower Drain, http://www.amazon.com/Plumbing-Wrench-Kitchen-Strainer-Retainer/dp/B00GYDTXXM, Nov. 27, 2013, Amazon.com.
Superior Tool, Superior Tool GIDDS2-2474716 Plumbers Pal, https://www.amazon.com/Superior-Tool-GIDDS2-2474716-Plumbers-Pal/dp/B007BB8TAE, Feb. 20, 2012, Amazon.com.

* cited by examiner

*Primary Examiner* — John C Hong
(74) *Attorney, Agent, or Firm* — Forrest Firm, P C.

(57) ABSTRACT

The presently disclosed subject matter is directed a hand-held wrench device that is advantageously sized and shaped to be used in confined locations (e.g., in the space immediately below a sink or behind a toilet). Particularly, the disclosed wrench device comprises a base portion and a body portion positioned aligned therewith. The body portion includes at least one cavity sized and/or shaped to accommodate at least a portion of the wing extension of a wing nut. In use, once the disclosed device is coupled to a nut, the nut can be tightened or loosened simply by rotating the device by hand about its own axis in a clockwise or counterclockwise direction.

17 Claims, 10 Drawing Sheets

HAND-HELD WRENCH DEVICE

TECHNICAL FIELD

The presently disclosed subject matter relates generally to hand-held wrench devices. More particularly, the presently disclosed subject matter relates to hand-held wrench devices for use in loosening and tightening connectors (such as nuts) in difficult-to-reach locations, such as basin drain connections and/or toilets.

BACKGROUND

Nuts used to secure kitchen and bathroom drain assemblies, toilet connections, and the like are typically located in confined areas that are difficult to engage with a standard wrench. Many plastic nuts have wings or flanges to facilitate turning by hand. In many cases, however, it still is necessary to use a wrench to ensure tightness and/or to loosen nuts that have become frozen in place through over-tightening and/or as a result of dissolved salts and minerals in the water. Although a variety of wrenches are known in the art, it would be beneficial to provide a wrench that promotes ease and convenience of use, facilitates engagement and gripping of fittings or other components, and is relatively compact to allow for loosening and tightening of nuts located in confined spaces.

SUMMARY

In some embodiments, the presently disclosed subject matter is directed to a wrench comprising a substantially U-shaped base portion comprising a first face and a second face, and a substantially U-shaped body portion attached to (and/or aligned with) the first face of the base portion. In some embodiments, the body portion comprises an outer wall and an inner wall comprising one or more cavities shaped and sized to house at least one portion of a connector. In some embodiments, the outer wall comprises one or more gripping elements comprising ribs, texturing, rubberized materials, or combinations thereof. In some embodiments, the cavities of the disclosed wrench are substantially U-shaped. In some embodiments, the cavities are uniformly spaced about the inner wall of the body portion. In some embodiments, the connector is a wing nut comprising at least one wing. In some embodiments, the at least one portion of a connector is the wing of the wing nut. In some embodiments, the base portion comprises a lip that extends beyond the inner wall of the body portion.

In some embodiments, the disclosed wrench further comprises a substantially U-shaped adaptor, wherein the adaptor comprises an outer wall comprising one or more protrusions sized and shaped to be housed within the one or more cavities of the wrench, and an inner wall sized and shaped to accommodate a connector. The adaptor is sized and shaped to be positioned adjacent to the inner wall of the wrench body portion. In some embodiments, the adaptor further comprises a lip positioned adjacent to the adaptor inner wall.

In some embodiments, the presently disclosed subject matter is directed to a method of loosening or tightening a connector. Particularly, the method comprises providing the disclosed wrench, providing a connector comprising one or more wings, aligning at least one wing of the connector with at least one cavity of the wrench such that the wing is housed within the cavity, and turning the wrench by applying pressure, whereby the connector is loosened or tightened. In some embodiments, the turning is done by hand. In some embodiments, the wrench is oriented such that the cavities are facing upwards when in use. In some embodiments, the wrench is oriented such that the cavities are facing downward when in use.

DETAILED DESCRIPTION

Figure 1A:
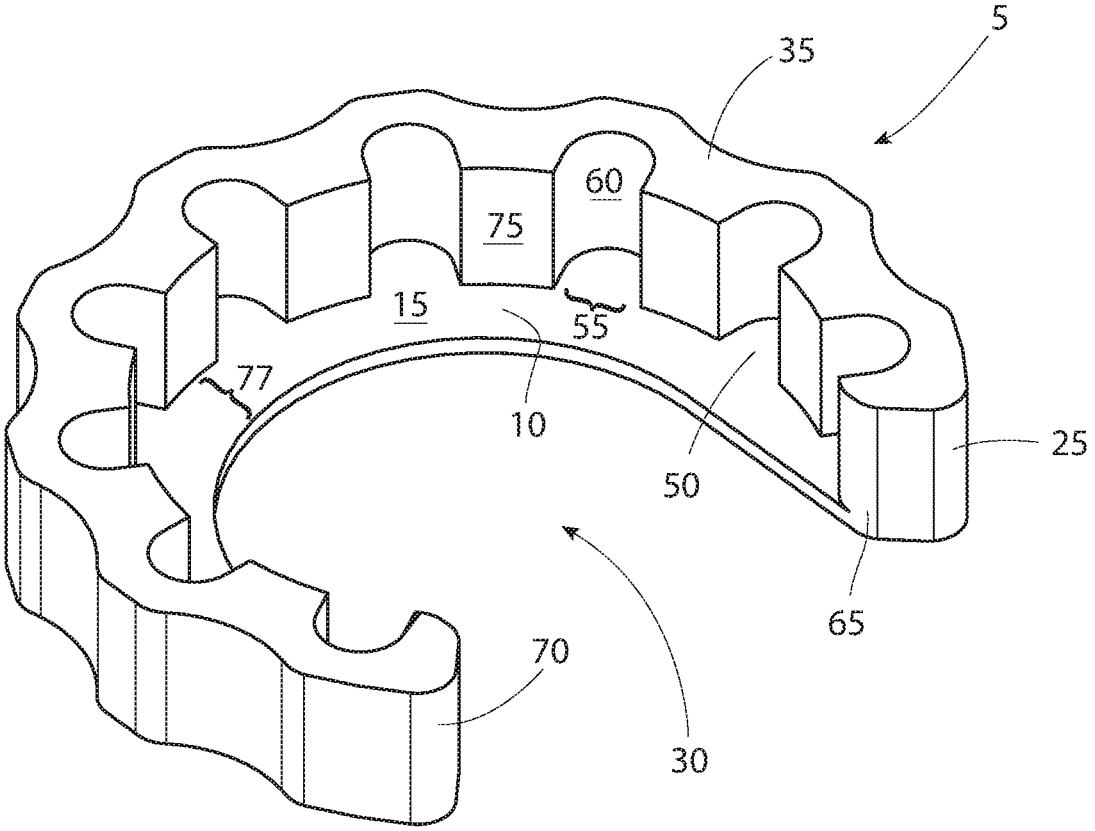
FIG. 1*a* is a perspective view of a handheld wrench device in accordance with some embodiments of the presently disclosed subject matter.

The presently disclosed subject matter will now be described more fully hereinafter with reference to the following description, in which some (but not all) embodiments are shown. The presently disclosed subject matter can, however, be embodied in different forms and should not be construed as limited to the embodiments set forth herein. Rather, these embodiments are provided so that the instant disclosure will be thorough and complete, and will fully convey the scope of the embodiments to those of ordinary skill in the art.

Unless otherwise defined, all technical and scientific terms used herein have the same meaning as commonly understood by one of ordinary skill in the art to which the presently disclosed subject matter pertains.

Following long standing patent law convention, the terms "a", "an", and "the" refer to "one or more" when used in the subject application, including the claims.

As used herein, the term "adaptor" refers broadly to any receptacle configured to receive a connector, such as (but not limited to) a nut or bolt. In some embodiments, the adaptor can be a part, assembly, or subassembly designed for use in conjunction with the disclosed device.

The terms "comprises" and "comprising" are intended to have the broad meaning ascribed to them in U.S. Patent Law and can mean "includes", "including", and the like.

The term "connector" as used herein refers to any of the wide variety of connecting devices known and used in the art, including (but not limited to) fittings, nuts, and the like.

The term "gripping element" as used herein refers to any of the wide variety of elements known and used in the art to allow a user to better grip a device. For example, suitable gripping elements can include (but are not limited to) ribs, texturing, and/or rubberized materials.

As used herein, the term "nut" can refer to any of the wide variety of connecting devices known and used in the art. For example, in some embodiments, a nut can refer to a wing nut, such as a plastic wing nut.

The term "substantially" as used herein refers to the complete or nearly complete extent or degree of a characteristic or property. For example, an object that is "substantially" U-shaped is either completely U-shaped or nearly completely U-shaped.

The terms "top", "bottom", "inner" and "outer" as used herein universally refer to an orientation with reference to the body of the disclosed device. For example, in some embodiments, the top portion of the disclosed wrench refers to the side facing upward, towards the sky.

The term "wrench" as used herein refers to an open-ended tool element that can communicate with a connector.

The presently disclosed subject matter is directed to a hand-held wrench device that is advantageously sized and shaped to be used in confined locations (e.g., in the space immediately below a sink or behind a toilet). Particularly, FIGS. 1*a*-2*b* illustrate one embodiment of wrench device 5 comprising base portion 10 that includes first face 15 and opposed second face 20. Device 5 further comprises body portion 25 positioned on first face 15 of base 10. As illustrated in the Figures, base portion 10 and body portion 25 can be configured in a U shape, where the interior portion of the U defines receiving space 30 adapted to receive a connector, such as (but not limited to) a wing nut.

Body portion 25 comprises upper face 35 that in some embodiments can be the top face of the device. However, in some embodiments the device can be oriented in the opposite direction such that second face 20 of base portion 10 is the top face of the device. See, for example, the embodiments shown in FIGS. 3*a* and 3*b*.

Figure 1B:
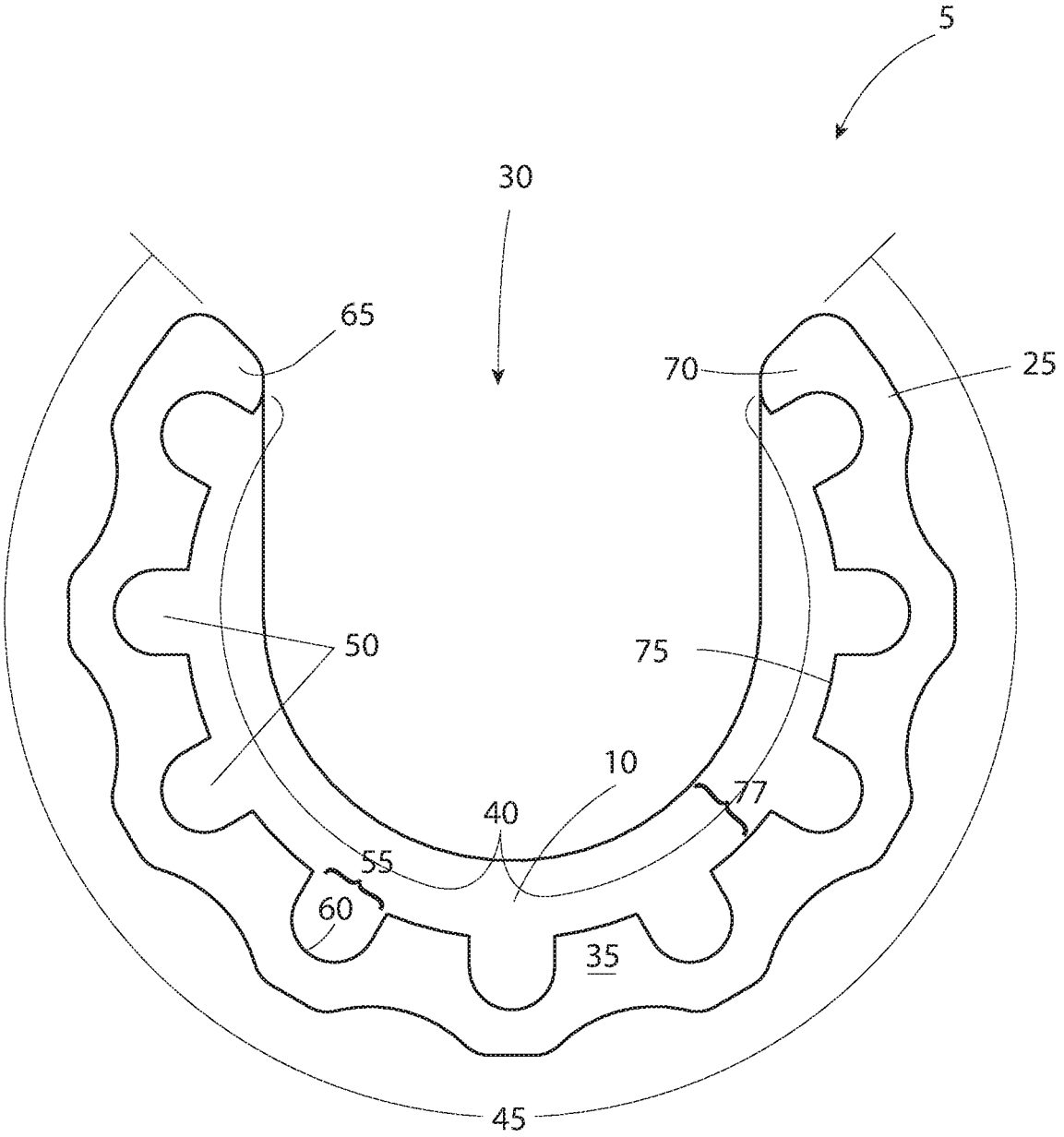
FIG. 1*b* is a top plan view of the device of FIG. 1*a*.

Body portion 25 comprises inner wall 40 and outer wall 45, as shown in FIG. 1*b*. The inner wall includes at least one cavity formed therein, positioned adjacent to receiving space 30. Particularly, as shown in FIGS. 1*a* and 1*b*, inner wall 40 of body 25 can comprise a plurality of cavities 50 with a thickness that extends from upper face 35 to base 10. Further, cavities 50 extend from inner wall 40 towards outer wall 45. Each cavity has open end 55 positioned on the inner wall of body 25 and opposed closed end 60. In some embodiments, each cavity 50 can be sized and/or shaped to accommodate at least a portion of a connector (such as the wing of a wing nut). However, the shape of cavity 50 is not limited and can be configured in any shape known or used in the art. To this end, cavities 50 can accommodate three-winged nuts, four-winged nuts, six-winged nuts, and the like (or combinations thereof) as desired. In some embodiments, each cavity is of about the same size or shape, while in other embodiments the cavities vary in size or shape to accommodate a variety of nuts. In some embodiments, cavities 50 are spaced about the circumference of inner wall 40 of body 25, i.e., from first end 65 to second end 70. Segments 75 of inner wall 40 are positioned between cavities 50. In some embodiments, segments 75 can be substantially flat or rounded.

In some embodiments, base portion 10 and body portion 25 are aligned (at least on outer wall 45 of the device). In some embodiments, base portion 10 extends beyond inner wall 40 of body 25 towards receiving space 30, thereby forming lip 77. Lip 77 can be used to assist the user in accurately positioning the disclosed device when in use, as would be appreciated by those of ordinary skill in the art.

Figure 2A:
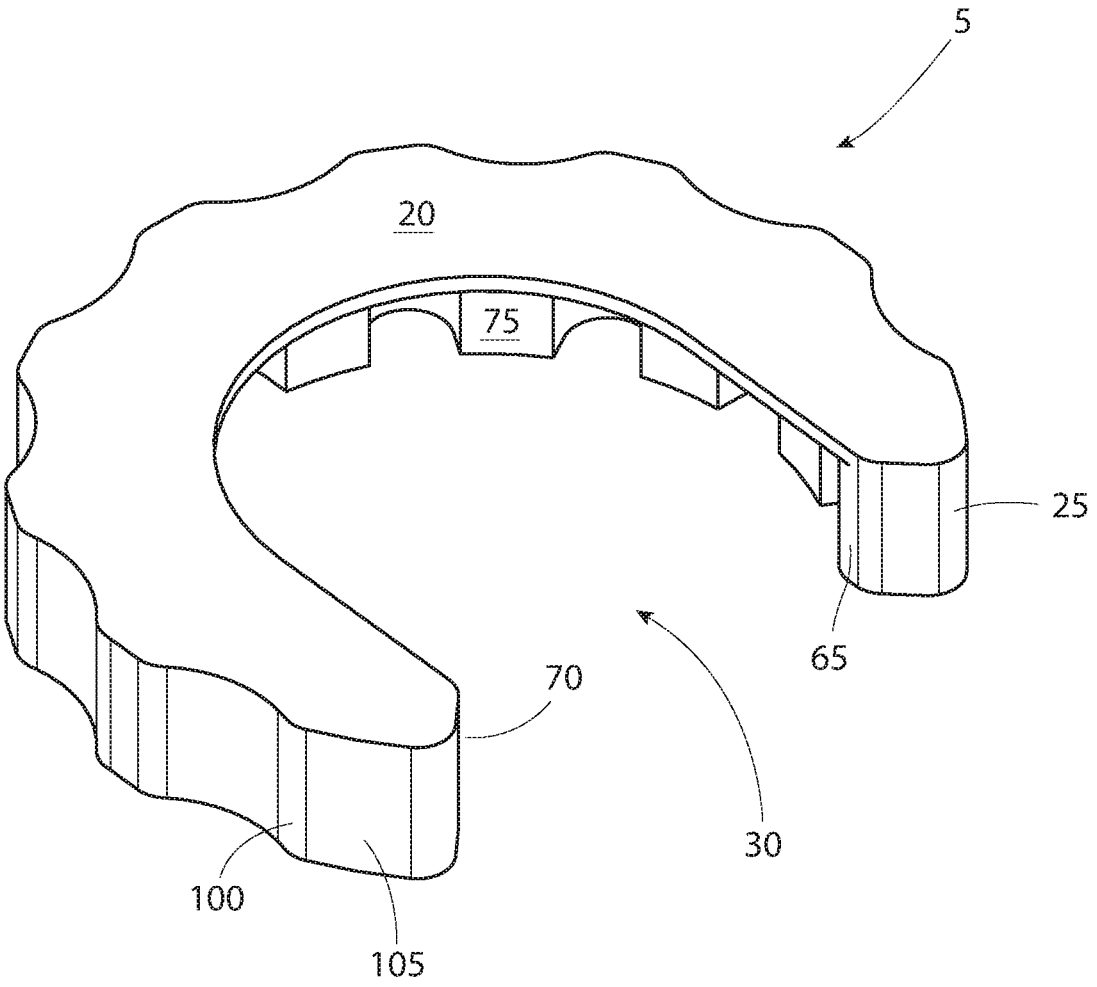
FIG. 2*a* is a perspective view of the device of FIG. 1*a* in an opposed orientation.
Figure 2B:
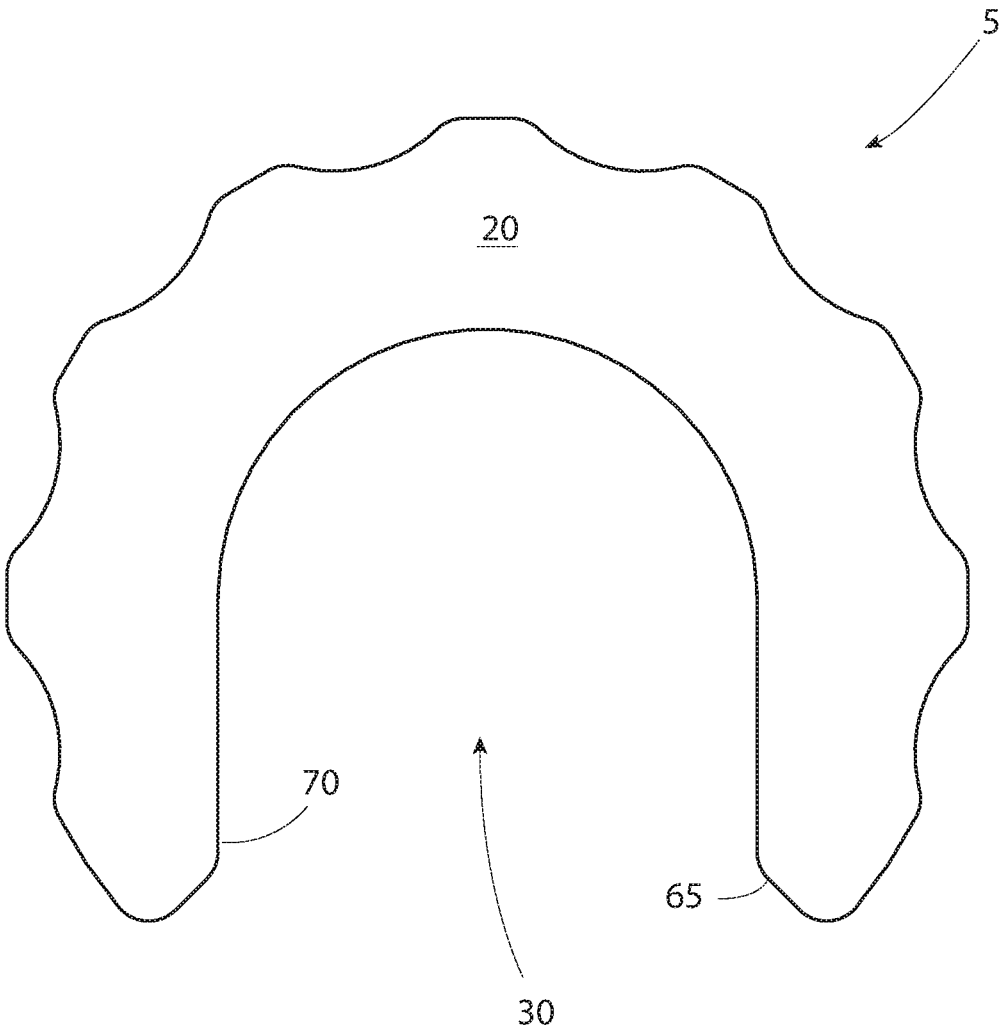
FIG. 2*b* is a top plan view of the device of FIG. 2*a*.

In some embodiments, device 5 comprises one or more gripping elements (such as ribs 100 and/or texturing 105) formed on an exterior surface of the body (i.e., outer wall 45) to improve grip and provide increased torque when loosening and/or tightening a nut, as shown in FIG. 2*a*. The ribs and/or texturing are configured such that the hand of a user can grip the disclosed device and provide sufficient torque to rotate and tighten or loosen an associated nut. In some embodiments the ribs function as finger depressions to enable the fingers of a hand to fit therein to provide a better grip on the device.

As set forth above, device 5 can be substantially U-shaped, i.e., base portion 10, body portion 25, lip 77, inner wall 40 and/or outer wall 45 can be substantially U-shaped. As set forth in detail herein below, in some embodiments the U-shape facilitates proper positioning of the disclosed device when in use. That is, the device can be turned around and reversed depending on the environment and/or direction of rotation, as shown in FIGS. 1*a* and 2*a*. The opening of the U shape (receiving space 30) provides an opening sized and/or shaped to permit an object to be tightened or loosed (i.e., a nut in some embodiments) to pass therethrough when setting the device in position. Advantageously, device 5 can be slipped over or under a nut in confined locations (e.g., the space immediately below a sink) and can be easily turned to tighten or loosen the nut.

Figure 3A:
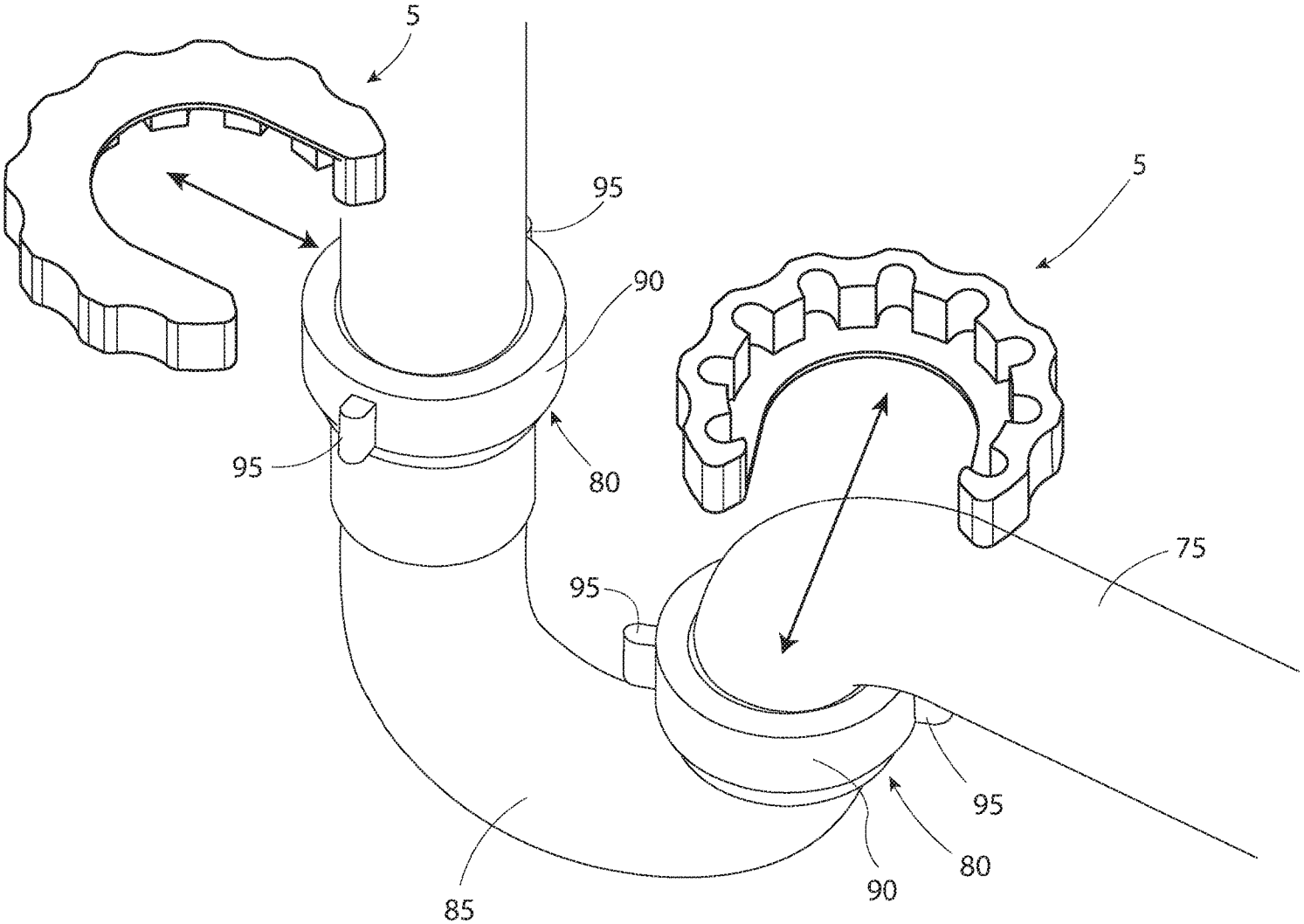
FIGS. 3*a*-3*b* are perspective views of the disclosed device in use in accordance with some embodiments of the presently disclosed subject matter.
Figure 3B:
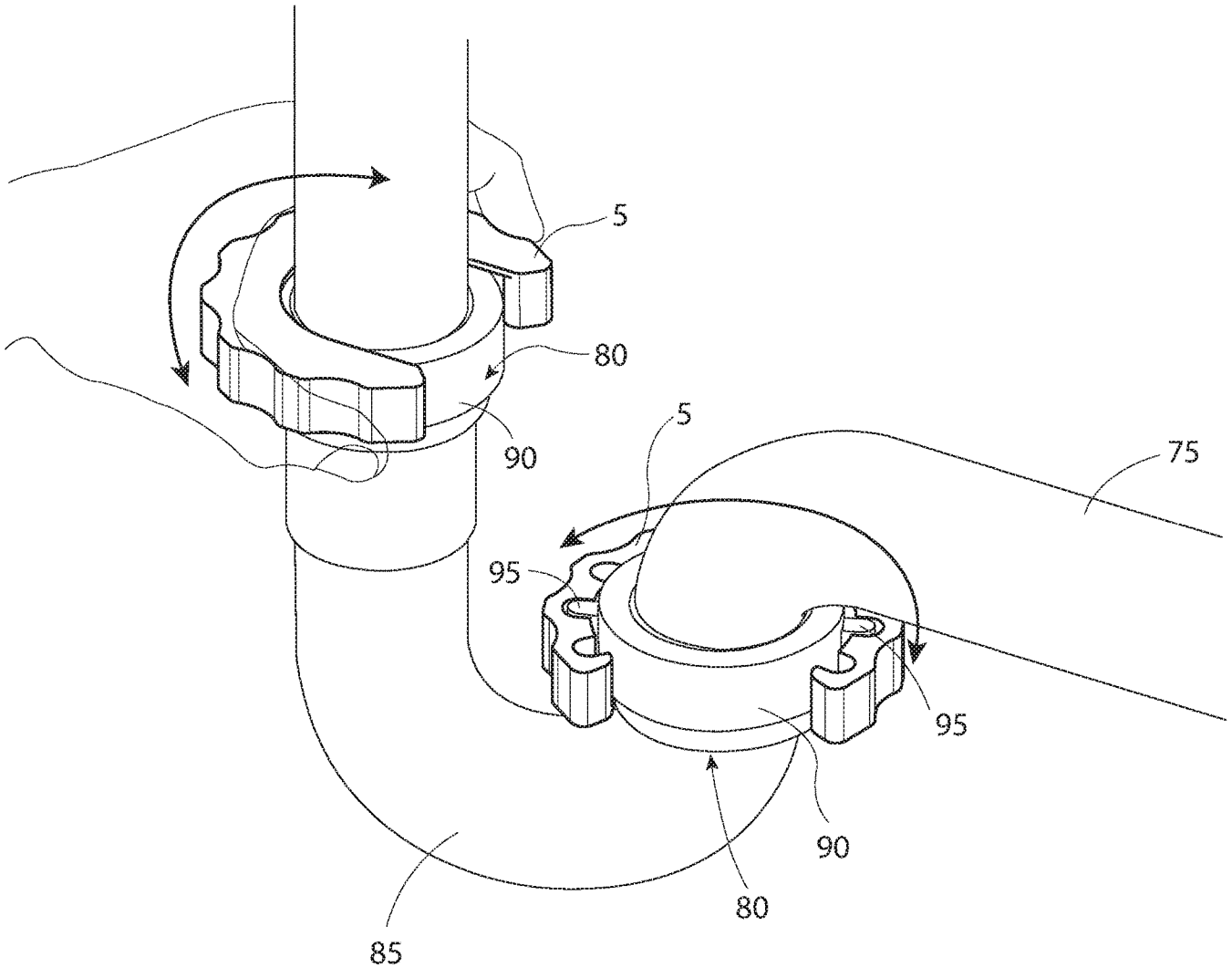

For example, FIG. 3*a* illustrates a typical plumbing unit comprising first and second pipes 75, 85 connected by wing nut 80. Wing nut 80 includes mid-portion 90 comprising angularly spaced wings 95 that can be used to turn the nut. When a user desires to position device 5 on an object to be loosened or tightened (such as, e.g., wing nut 80), the object is maneuvered through receiving space 30 of device 5 to abut or contact lip 77. That is, device 5 is slipped over or under pipes 75 and/or 85 and is telescoped onto mid-portion 90 of nut 80. In doing so, the device is in proper position for aligning wings 95 with cavities 50, as shown in FIG. 3*b*. The depth of cavities 50 are such that wings 95 are at least partially received in the cavities. In some embodiments, the wings are fully received in the cavities. With device 5 and nut 80 coupled by virtue of cavities 50 and wings 95, the nut can be tightened or loosened simply by rotating the device by hand about its own axis in a clockwise or counterclockwise direction, depending on whether the nut is to be tightened or loosened.

It should be appreciated that the disclosed device can be used on any of a wide variety of connectors to be tightened or loosened and is not limited to wing nuts as shown in FIGS. 3*a* and 3*b*. Rather, the Figures are shown for illustration purposes only and are not intended to be limiting. Further, although depicted in the Figures as a device to loosen and tighten nuts employed to secure drain pipes from a sink (plumbing applications), it is to be understood that device 5 can be used to loosen and tighten any of a wide variety of connectors in non-plumbing applications.

Figure 4A:
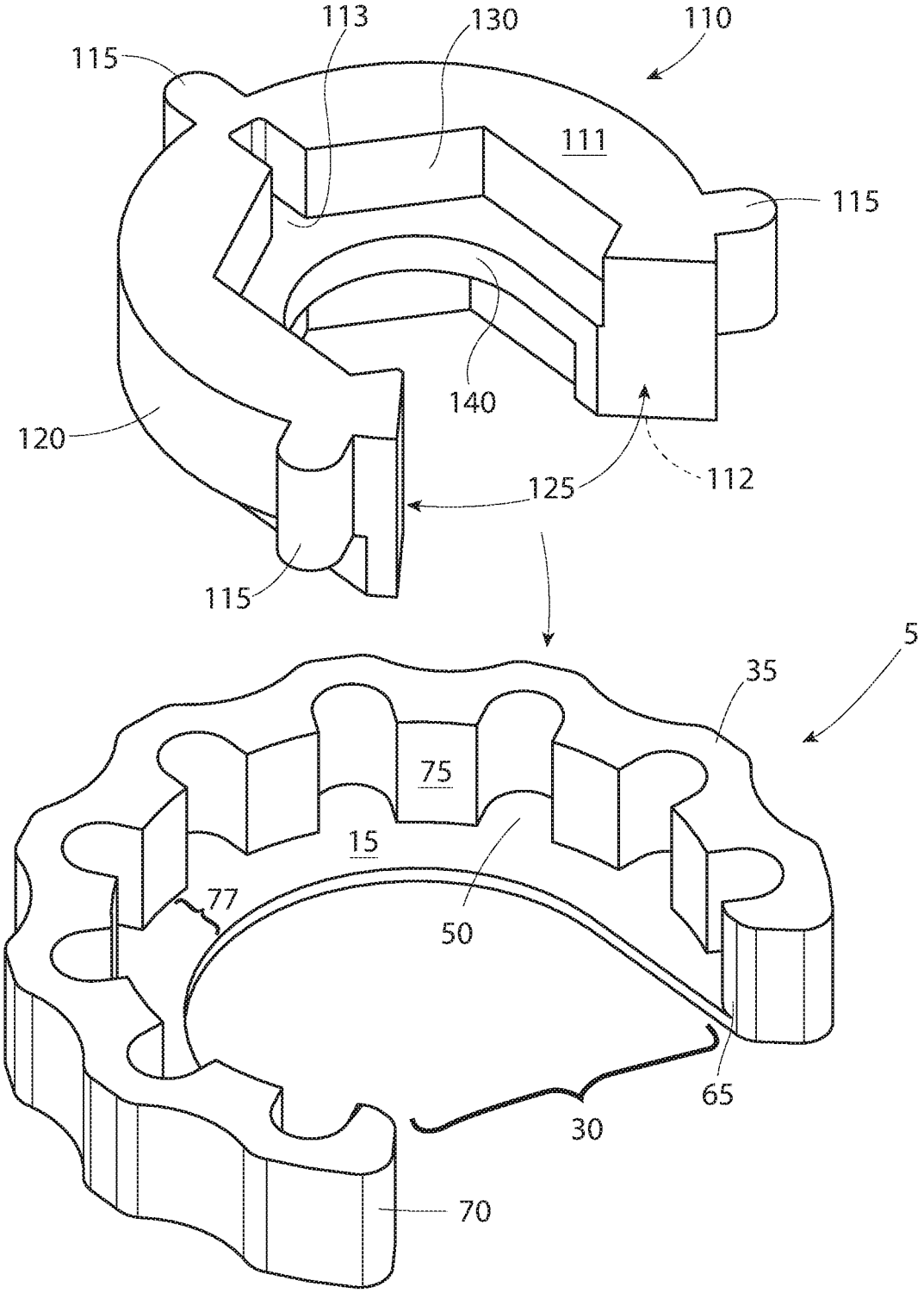
FIG. 4*a* is a perspective view of a disclosed device and an adaptor.
Figure 4B:
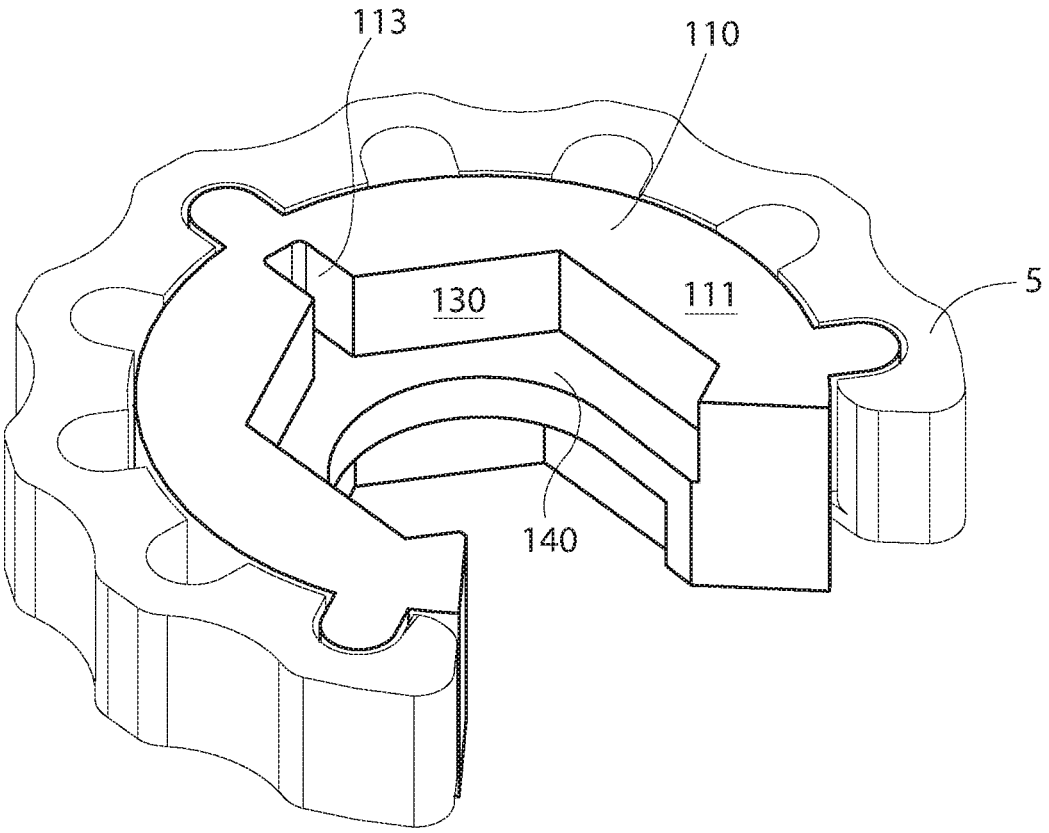
FIG. 4*b* is a perspective of the disclosed device fitted with an adaptor.

In some embodiments, the disclosed device can comprise one or more adaptors. For example, as shown in FIGS. 4*a* and 4*b*, device 5 can include adaptor 110 that enables the device to be used with a wide variety of nuts or other connectors. For example, in some embodiments, the adaptor can be configured as an insert that snaps into device 5. Particularly, adaptor 110 can include one or more protrusions 115 sized and shaped to fit into cavities 50 of device 5. In some embodiments, the protrusions are positioned on outer wall 120 of the adaptor, thereby allowing the interior of the adaptor to at least partially overlay receiving space 30 of device 5. In some embodiments, adaptor 110 comprises lip 140, positioned between the top and bottom faces 111, 112 of the adaptor. The adaptor includes inner opening 125 sized and shaped to allow a nut (or other connector) to pass there through and interior face 130 sized and shaped to accommodate a desired nut (or other connector). In some embodiments, the interior face of adaptor 110 comprises at least one cavity 113 sized and shaped to house at least a portion of a connector (such as, but not limited to, a wing). In some embodiments, device 5 and adaptor 110 are of the same thickness, such that the top faces of both are aligned when attached as depicted in FIG. 4*b*.

Figure 5A:
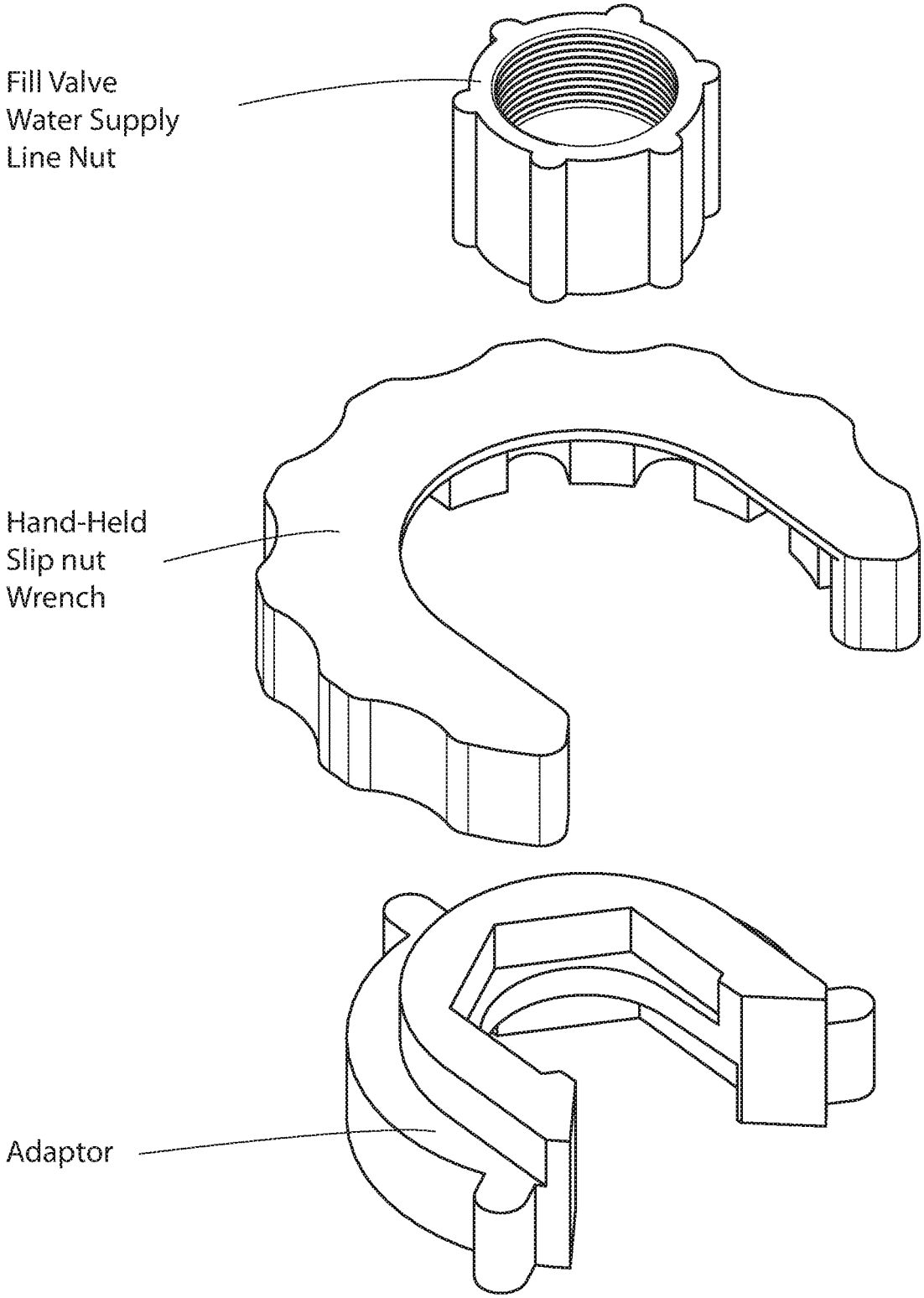
FIG. 5*a* is a perspective view of one embodiment of the disclosed device, adaptor, and nut.
Figure 5B:
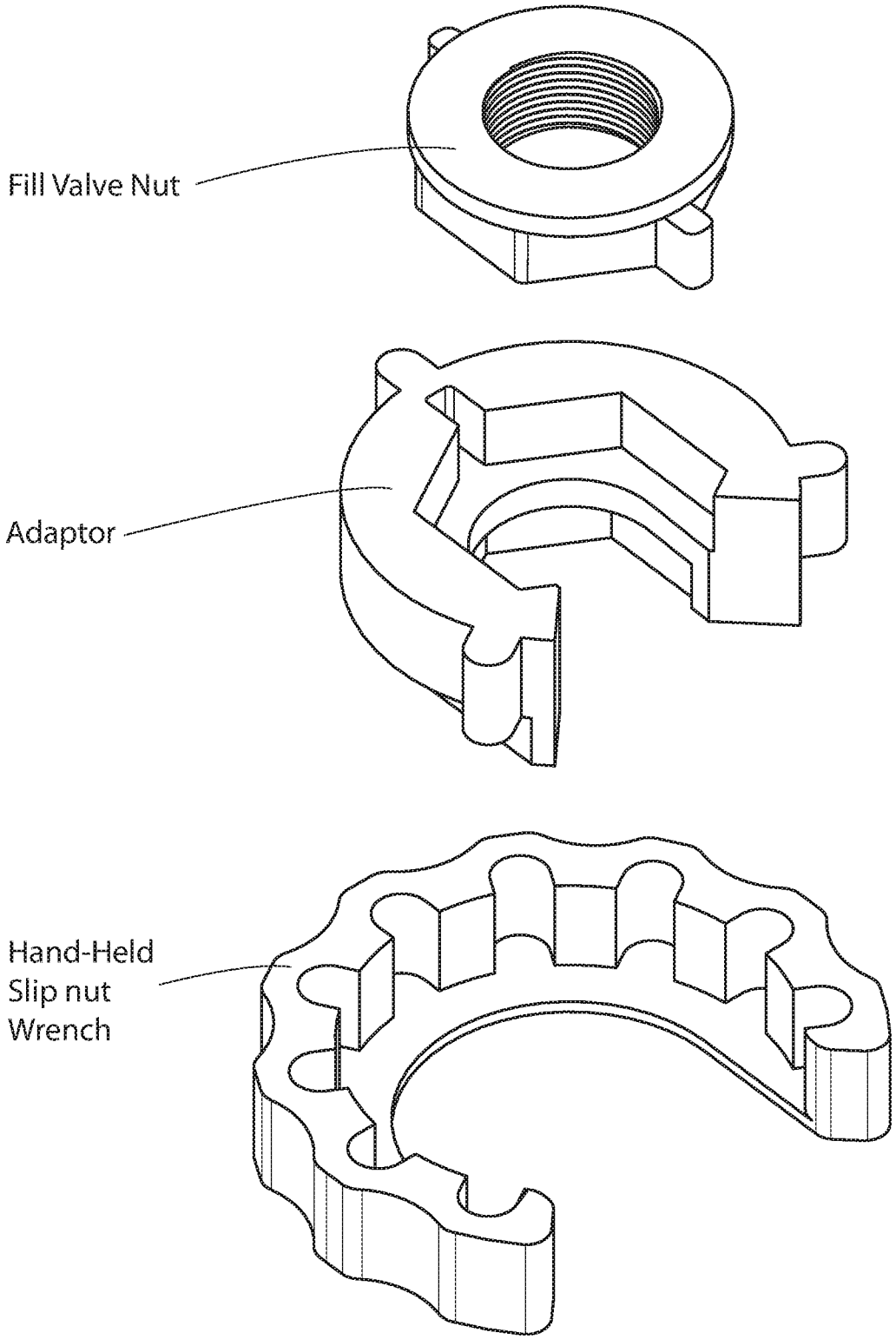
FIG. 5*b* is a perspective view of one embodiment of the disclosed device, adaptor, and nut.

In use, adaptor 110 can be removably attached to device 5 by pushing or otherwise positioning protrusions 115 into cavities 50, as shown in FIG. 4*b*. Once properly positioned, the device can tighten or loosen a nut as set forth above (i.e., grasping outer wall 45 and rotating the device in a clockwise or counterclockwise direction). The adaptor can be removed by pulling the adaptor and/or device to cause separation. Thus, in some embodiments, adaptor 110 can function to allow device 5 to engage various types of connectors. For example, in some embodiments, adaptor 110 can be used to tighten and/or loosen the water supply line nut on a toilet (as shown in FIG. 5*a*) or the fill valve tank-to-bowl nut (as shown in FIG. 5*b*).

In some embodiments, device 5 (and/or adaptor 110) can be constructed from a molded rigid plastic material. However, it should be appreciated other materials, e.g. metal, composites, and the like can also be used. For example, in some embodiments, device 5 can be constructed of a strong, lightweight nylon or other plastic material that has sufficient strength to turn a nut, but will not mar the nut when turned. In some embodiments, the disclosed device can be molded in one piece to minimize costs. That is, in some embodiments, base portion 10 and body portion 25 are integrally formed as a single and inseparable component of the same material. However, in some embodiments, body portion 25 and base portion 10 are separate components that can be attached using any method known in the art, including (but not limited to) adhesives, welding, mechanical fasteners, and the like.

It should be understood that various changes and modifications to the preferred embodiments described herein would be apparent to those skilled in the art. Such changes and modifications can be made without departing from the spirit and scope of the presently disclosed subject matter. It is therefore intended that such changes and modifications be covered by the appended claims.

What is claimed is:

1. A wrench comprising:

a substantially U-shaped base portion comprising a first face opposite a second face; and a substantially U-shaped body portion comprising a top wall opposite a bottom wall, wherein the top wall is wholly coupled to the first face of the base portion;

an inner wall defined by the body portion and extending between the top wall and the bottom wall;

one or more cavities defined by the inner wall and the first face; and a substantially U-shaped receiving space defined by the base portion and the inner wall of the body portion for receiving a connector through the receiving space, wherein the one or more cavities are shaped to house at least one wing of the connector.

2. The wrench of claim 1, wherein an outer wall opposite the inner wall comprises one or more gripping elements.

3. The wrench of claim 2, wherein the gripping elements comprise ribs, texturing, rubberized materials, or combinations thereof.

4. The wrench of claim 1, wherein the cavities are substantially U-shaped.

5. The wrench of claim 1, wherein the cavities are uniformly spaced about the inner wall of the body portion.

6. The wrench of claim 1, wherein the base portion comprises a lip that extends interiorly beyond the entire inner wall of the body portion.

7. The wrench of claim 1, further comprising a substantially U-shaped adaptor, wherein the adaptor comprises:

an outer wall comprising one or more protrusions sized and shaped to be housed within the one or more cavities of the wrench; and an inner wall sized and shaped to accommodate a connector;

wherein the adaptor is sized and shaped to be positioned adjacent to the inner wall of the wrench body portion.

8. The wrench of claim 7, wherein the adaptor further comprises a lip positioned adjacent to the adaptor inner wall.

9. The wrench of claim 7, wherein the inner wall comprises one or more cavities sized and shaped to house at least a portion of a connector.

10. A method of loosening or tightening a connector, said method comprising:

providing the wrench of claim 1;

providing a connector comprising one or more wings;

aligning at least one wing of the connector with at least one cavity of the wrench such that the wing is housed within the cavity and nests against the first face; and turning the wrench by applying pressure, whereby the connector is loosened or tightened.

11. The method of claim 10, wherein the turning is done by hand.

12. The method of claim 10, wherein the outer wall of the wrench comprises ribs, texturing, rubberized materials, or combinations thereof.

13. The method of claim 10, wherein the cavities are substantially U-shaped.

14. The method of claim 10, wherein the cavities are uniformly spaced about the inner wall of the body portion.

15. The method of claim 10, wherein the wrench further comprises a substantially U-shaped adaptor, and wherein the adaptor comprises:

an outer wall comprising one or more protrusions sized and shaped to be housed within the one or more cavities; and an inner wall sized and shaped to accommodate a connector;

wherein the adaptor is sized and shaped to be positioned adjacent to the inner wall of the wrench body portion.

16. The method of claim 10, wherein the wrench is oriented such that the cavities are facing upwards when in use.

17. The method of claim 10, wherein the wrench is oriented such that the cavities are facing downward when in use.

* * * * *